US006755890B1

(12) United States Patent
Hanniala et al.

(10) Patent No.: US 6,755,890 B1
(45) Date of Patent: Jun. 29, 2004

(54) METHOD FOR REDUCING NON-FERROUS METAL CONTENT IN SLAG IN THE PRODUCTION OF NON-FERROUS METALS OCCURRING IN SUSPENSION SMELTING FURNACE

(75) Inventors: Pekka Hanniala, Espoo (FI); Ilkka Kojo, Kirkkonummi (FI); Risto Saarinen, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/019,970

(22) PCT Filed: May 8, 2000

(86) PCT No.: PCT/FI00/00406

§ 371 (c)(1),
(2), (4) Date: Apr. 12, 2002

(87) PCT Pub. No.: WO00/70104

PCT Pub. Date: Nov. 23, 2000

(30) Foreign Application Priority Data

May 14, 1999 (FI) ..... 991109

(51) Int. Cl.[7] ..... C22B 15/00

(52) U.S. Cl. ..... 75/640; 75/585; 75/648; 75/654; 75/640; 266/229; 266/231

(58) Field of Search ..... 75/585, 648, 654; 266/229–231

(56) References Cited

U.S. PATENT DOCUMENTS 4,568,065 A * 2/1986 Talonen ..... 266/157
4,639,269 A 1/1987 Hilbrans et al.
4,857,104 A * 8/1989 Victorovich et al. ..... 423/48
5,662,730 A 9/1997 Akagi et al.
6,270,554 B1 * 8/2001 Queneau et al. ..... 266/177

FOREIGN PATENT DOCUMENTS

| | | |
|---|---|---|
| DE | 33 41 154 A1 | 5/1985 |
| JP | 5 822 1241 | 12/1983 |
| JP | 5950132 | 3/1984 |
| JP | 9 316 562 | 6/1999 |

OTHER PUBLICATIONS

Hastie, C. W.; Hall, D.R.T.; Hohnen, C.A.; Limerick, J.M.; "Kalgoorlie Nickel Smelter: Integration of Flash Smelting and Slag Cleaning Within One Process Unit", The AusIMM Melbourne Branch, Symposium on "Extractive Metallurgy", Nov. 1984. (University of New South Wales Library, Accession Date May 8, 1985).

Day, Bruce E.; Raston, Gary R.; Remilton, David G.; "Technological Innovations to Reduce Operating Costs at Kalgoorlie Nickel Smelter"; The AusIMM North Queensland Branch, Smelting and Refining Operators Symposium, May 1985. (University of New South Wales Library, Accession Date Jul. 15, 1985).

(List continued on next page.)

*Primary Examiner*—Roy King
*Assistant Examiner*—Andrew Wessman
(74) *Attorney, Agent, or Firm*—Morgan & Finnegan, L.L.P.

(57) ABSTRACT

The present invention relates to a method, whereby the non-ferrous metal content of the slag generated in the production of non-ferrous metals such as copper or nickel in a suspension smelting furnace is reduced by charging metallurgical coke, with a size ranging from 1–25 mm, into the furnace. Baffles can be positioned from the roof of the furnace downwards, by means of which small particles containing copper and nickel are prevented from drifting to the back of the furnace and being tapped with the slag. The baffles force the small particles to settle in the reduction zone of the furnace.

12 Claims, 2 Drawing Sheets

OTHER PUBLICATIONS

Figure 1:
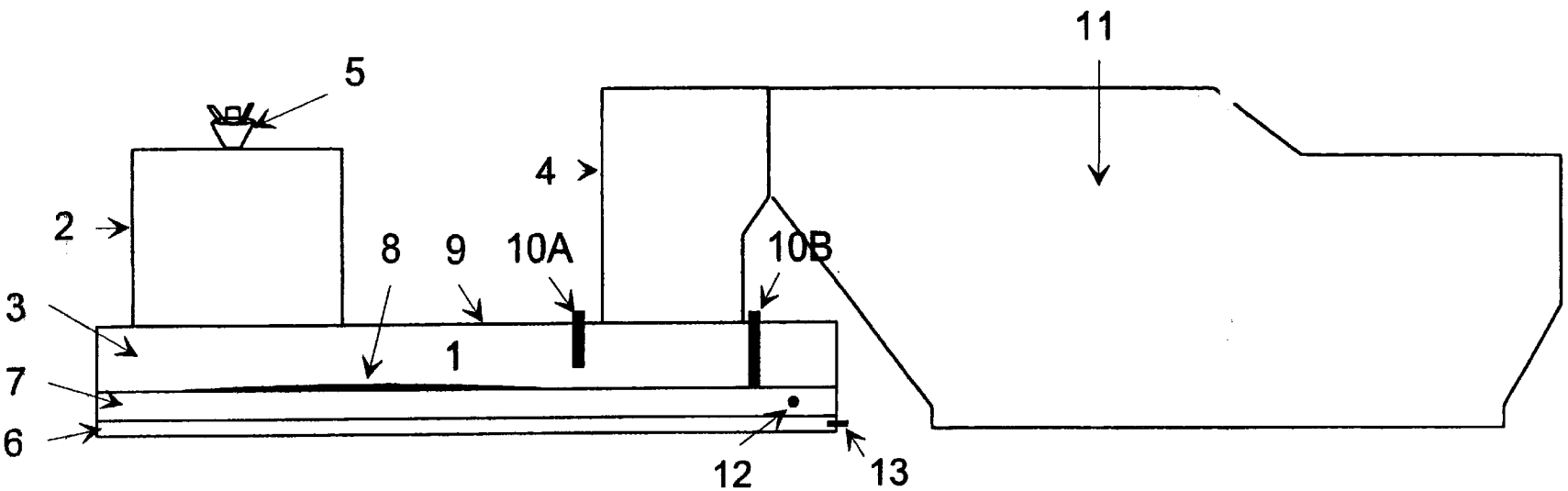

Slater, P.; "Nickel Smelting Operations at Kalgoorlie"; A Seminar on Pyrometallurgical Operations in Western Australia, Murdoch University, Nov. 9, 1990. (National Library of Australia, Accession Date Jan. 15, 1991). pp. 7–22.

Hunt, Arthur G.; "Nickel Smelting at the Kalgoorlie Nickel Smelter of Western Mining Corporation Limited"; Australasian Mining and Metallurgy: The Sir Maurice Mawby Memorial vol. , p1119–1203, AusIMM Monograph Series 19, 1993. (University of New South Wales Library, Accession Date Jan. 3, 1995).

Apelt, T.A.; Hunt, A.G.; Elliot, B.J.; "The 1993 Rebuild and Upgrade of Kalgoorlie Nickel Smelter"; CIM Bulletin, *88* (992), 97–104, 1995. (University of New South Wales Library, Accession Date Nov. 14, 1995).

Sannikov, Y.I.; Liamina, M.A.; Shumskij, V. AA.; Grinin, Y.A.; Radashin, M.V.; "A Physical and Chemical Description of the Kivcet Lead Flash Smelting Process"; CIM Bulletin *91* (1022), 76–81, 1998. (University of New South Wales Library, Accession Date Oct. 8, 1998).

Kulenov, A.S.: Sannikov, Y.I.; Slobodkin, L.V.; Ushakov, N.N.; "The KIVCET Process? A Unique Technology for the Smelting of Raw Material Containing Lead, Zinc and/or Copper"; ERZMETALL *51* (4), 273–279, 1998. (Monash University Hargrave–Andrew Library, Accession Date Jul. 1, 1998).

Derwent WPI Acc No. 1984–172960 / 198428 Abstract.

* cited by examiner

METHOD FOR REDUCING NON-FERROUS METAL CONTENT IN SLAG IN THE PRODUCTION OF NON-FERROUS METALS OCCURRING IN SUSPENSION SMELTING FURNACE

The present invention relates to a method, whereby the non-ferrous metal content of the slag generated in the production of non-ferrous metals such as copper or nickel in a suspension smelting furnace is reduced by feeding metallurgical coke, whose size ranges from 1–25 mm, into the furnace. It is advantageous to place baffles from the roof of the furnace downwards, by means of which small particles containing copper and nickel are prevented from drifting to the back of the furnace and exiting together with the slag. The baffles force small particles to settle in the reduction zone of the furnace.

It is known before that slag with low copper content can be produced in suspension smelting furnaces such as flash smelting furnaces, when fixed coke or some other carbonaceous substance is used in the reduction of slag and the copper oxidule dissolving therein and especially magnetite which increases the viscosity of the slag and slows down the separation of molten matte particles contained in the slag by settling.

In U.S. Pat. No. 5,662,370 a method is described in which it is essential that the carbon content of the carbonaceous material to be fed to the reaction shaft is at least 80%, that at least 65% of the material particles are under 100 $\mu$m and at least 25% between 44–100 $\mu$m. Particle size is defined precisely, because, according to said patent, the reduction of magnetite with unburnt coke occurs under two mechanisms and particle size is of decisive significance with regard to said mechanisms. If the rough coke powder size is roughly 100 $\mu$m or greater, the unburnt part particle size is also great and for this reason coke remains floating on the slag surface and reactions are slow. When the particle size is reduced, the powder coke enters the slag and then into direct contact with the magnetite to be reduced, which accelerates the reaction rate.

In Japanese patent application 58-221241 a method is described in which coke breeze or coke breeze together with pulverized coal are fed into the reaction shaft of a flash smelting furnace through a concentrate burner. The coke is fed into the furnace so that the entire surface of melt in the lower furnace is evenly covered with the unburnt powder coke. According to the application, the degree of reduction of magnetite decreases when the grain size is ultra-fine, so the grain size used is preferably from 44 $\mu$m to 1 mm. The slag layer covered by unburnt coke, which remains on the molten slag bath decreases considerably the partial pressure of oxygen. The highly reducing atmosphere arising from the coke layer causes for example damages to the lining of the furnace.

In JP patent 90-24898 a method is described in which pulverized coke or coal with particle size of under 40 mm is fed into a flash smelting furnace to replace the oil used as an extra fuel and maintain the desired temperature in the furnace.

JP patent application 9-316562 applies to the same method as the previously mentioned U.S. Pat. No. 5,662,370. The difference from the method of the US patent is that carbonaceous material is fed to the lower part of the reaction shaft of the flash smelting furnace, to prevent said carbonaceous material from burning before it reaches the slag and the magnetite to be reduced contained therein. The particle size of the carbonaceous material is essentially the same as the distribution described in the US patent.

In some of the previously described methods the small particle size of the coke presents a weakness, in that small coke particles do not settle at all from the gas phase but continue with the gas phase to the uptake and on to the waste-heat boiler as a reducing agent. In the boiler the coke particles react and generate unnecessary energy in the wrong place, which may even limit total process capacity as the waste-heat boiler capacity diminishes.

In a suspension smelting furnace, not only does pulverized material such as cuprous oxides drift with the gas phase to the back of the furnace and the uptake but also copper matte particles. When these small particles separate from the gas flow in the back of the furnace and settle to the surface of the slag phase, this phenomenon is very slow due precisely to the small particle size. Because slag is mainly tapped from the back or side of the furnace, these particles do not manage to settle through the slag phase but instead, they drift in connection with slag tapping out of the furnace and add to the copper content of the slag.

In order to solve the previously described problems, a method has now been developed, with which the drawbacks of previous methods can be avoided. In the newly developed method, the aim is to lower the non-ferrous metal content of the slag generated in the production of non-ferrous metals such as copper or nickel in a suspension smelting furnace so that the slag would be discardable slag that would not require further processing. In this method, metallurgical coke, whose size ranges from 1–25 mm, is used to reduce the slag wherein most of the coke to be fed through the reaction shaft separates in the lower furnace of the suspension smelting furnace from the gas phase and settles on the surface of the slag phase, in which reduction of the slag occurs in an area where the majority of the product obtained as matte and slag separates from each other. The essential features of the invention will become apparent in the attached patent claims.

In this method, it is preferable to use metallurgical coke, because the amount of volatile substances contained therein is small. Therefore, the major part of the reduction potential of the raw materials in question can be used in reduction, without generating redundant additional thermal energy when the volatile substances in the reducing material burn. At the same time, the number of oxygen-binding reactions which happen to the coke in the reaction shaft is decreased, which allows for better control of the quality of the resulting matte. Traditionally, this control has been achieved by adjusting the air co-efficient in the process (oxygen/concentrate amount $Nm^3/t$).

In the method of the present invention, the metallurgical coke used is of a certain grain size, so that most of the coke to be fed through the reaction shaft separates from the gas phase in the lower furnace of the suspension smelting furnace and settles on the surface of the slag phase where the slag reduction takes place in an area in which also matte and slag which are main part of the products, separate from the gas phase. Reduction takes place in the area optimal from the point of heat economy: the heat required for reduction comes from the heat content of the products coming from the reaction shaft, without any additional energy being required in reduction.

The grain size of the metallurgical coke is preferably 1–25 mm. Bigger size coke has such a small specific area, that it will not react effectively with the slag. If a smaller grain size is used, such as the previously mentioned 1–25 mm, the coke will react actively already in the reaction shaft and more of it will drift with the gas phase to the uptake and the desired slag contact and reduction effect will be poor. When fine grained coke drifts with the gas phase to the uptake and/or waste-heat boiler, it produces energy at a stage when it is not needed and will thereby reduce the capacity of the boiler. The coke feed is controlled in such a way that a considerable amount of coke does not build up in the furnace, at most only a few centimetres but instead, all the coke is consumed in the reduction reactions.

In the method of the present invention also, the settling of pulverized matte material on the surface of the slag phase still causes the same problem to some extent as previously described: small particles containing copper or nickel do not manage to settle through the slag phase but stay in the slag, thereby raising the copper and nickel content of the slag being tapped off. In our method, this problem is preferably overcome in the way described: by positioning baffles from the roof of lower furnace section of the suspension smelting furnace. These will hinder the drifting of fine grained particles with the gas phase to the back of the furnace near the tapping holes. The baffles are positioned from the furnace roof downwards so that at their lower part, they reach either the molten slag bath or near its surface. The baffles are preferably constructed from water-cooled copper elements, which are protected with a fireproof material such as brick or refractory masses.

Thanks to the baffles, matter containing the most fine grained copper or nickel is made to settle in the reduction zone. In this way, the slag in the tapping area no longer contains substances forming of non-ferrous metal particles that settle slowly and increase copper content of the slag. The slag that is tapped from the tapping hole has a lower copper or nickel content than when operating without coke reduction and baffles.

Figure 2:
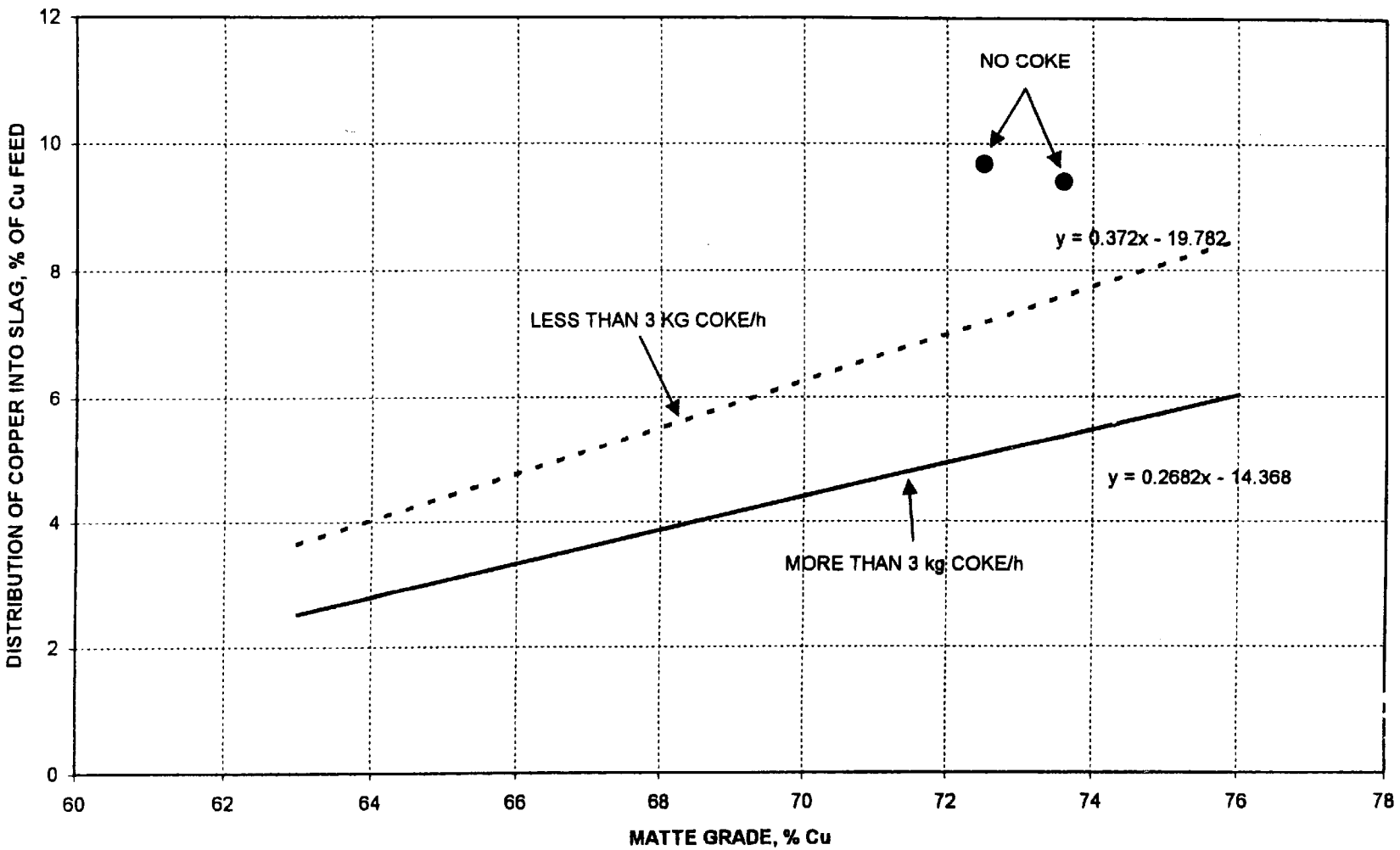

The furnace construction of the present invention is described in more detail in the attached diagrams, where FIG. 1 is a cross-section of a suspension smelting furnace and FIG. 2 shows the effect of the feed amount of coke on the end products from the suspension smelting furnace.

In FIG. 1, a suspension smelting furnace 1 consists of a reaction shaft 2, a lower furnace 3 and an uptake 4. Metallurgical coke is fed via a concentrate burner 5 located at the top of the reaction shaft 2 to the furnace with copper concentrate, a flux and oxygen-containing gas. In the reaction shaft, the infed materials react together, with the exception of coke, and form a matte layer 6 on the bottom of the lower furnace, on top of which is a slag layer 7. The reactions occurring in the reaction shaft between the metallurgical coke and other materials fed therein are minor due to the selected grain size, and the coke settles as a layer 8 on top of the slag layer, wherein the desired reduction reactions occur.

The lower furnace roof 9 is furnished with either one or several baffles 10A and 10B, which are suspended from the roof downwards to reach either the inside of the molten slag layer 7 (10B) or near the molten slag surface (10A). It can also be seen in the diagram that the baffles are preferably placed either in front of or behind the uptake, before the slag-tapping hole. Gases generated by reactions in the reaction shaft are removed via the uptake 4 to a waste-heat boiler 11. The slag and copper matte in the lower furnace are tapped through tapping holes 12 and 13 which are located at the back of the furnace.

EXAMPLE

The effect of metallurgical coke was demonstrated in a mini-scale flash smelting furnace (MFSF) by feeding an exact dose of 100–150 kg/h of concentrate into the furnace. The analysis of the concentrate was on average 25.7% Cu, 29.4% Fe and 33.9% S together with a converter slag and necessary silica flux. The amounts of flux and converter slag charged corresponded to 26–33% of the amount of concentrate. The copper content of the matte produced was 63–76% Cu. At testing points where the feedstock also included coke, the coke charge was 2–6 kg/h or between 1.0 and 3.1% of the concentrate feed. 80% Cf. coke was used, with an ash content of 16.3% and volatile amounts of 3.3%. Two different coke fractions and their compounds were used in the tests, a 1–3 mm fraction and 3–8 mm fraction.

In the campaign, one test lasted between 3 and 5 hours, after which the product was tapped from the furnace. In some of the test runs, no reduction coke was used at all for comparison purposes. The results of the campaign are presented in FIG. 2, which shows the distribution of copper left into the slag out of the total feed copper as a function of the copper percentage in the copper matte. The diagram shows that even a small addition of coke resulted in a considerable improvement of copper content in the slag in said furnace: in a charge of under 3 kg/h coke about 77.5% of the copper remained in the slag compared with the test runs without the use of coke. When bigger amounts of coke were used, the amount of copper in the slag was only 54.7% compared with the tests without coke. Therefore, the effectiveness of the method is obvious. A better reduction result was achieved with the coarser fraction than by using only the finer one, where up to a third of the coke had already reacted in the reaction shaft of the MFSF, and an effective reduction on the slag was not achieved.

What is claimed is:

1. A method for reducing non-ferrous metal content of a slag generated in the production of a non-ferrous metal in a suspension smelting furnace comprising feeding metallurgical coke into the furnace in addition to concentrate, oxygeneous gas and flux in order to reduce the slag, the coke charged to the furnace being metallurgical coke, which has a grain size in the region of 1–25 mm, and placing baffles into the furnace from the roof down to prevent drifting of small particles containing non-ferrous metal to the back of the furnace and out of the furnace with the slag.

2. The method of claim 1, wherein the coke is fed via a concentrate burner.

3. The method of claim 1, wherein the baffles extend inside the molten slag bath.

4. The method of claim 1, wherein the baffles extend near the surface of the slag layer.

5. The method of claim 1, wherein the baffles are manufactured from water-cooled copper elements, which are protected by a fireproof material.

6. The method of claim 1, wherein the non-ferrous metal is copper.

7. The method of claim 1, wherein the non-ferrous metal is nickel.

8. The method of claim 1, wherein the baffles are placed in front of an uptake before a slag tapping hole in the furnace.

9. The method of claim 1, wherein the baffles are placed behind an uptake before a slag tapping hole in the furnace.

10. The method of claim 1, wherein gases generated by reactions in the reactor are removed via an uptake in the furnace.

11. The method of claim 10, wherein the gases are removed to a waste boiler.

12. The method of claim 1, wherein slag and copper matter are removed from the furnace through a tapping hole located at the back of the furnace.

* * * * *